United States Patent [19]

Damm et al.

[11] Patent Number: 4,818,112

[45] Date of Patent: Apr. 4, 1989

[54] PROCESS FOR MIXING FOUNDRY MOLDING MATERIALS

[75] Inventors: Norbert Damm, Karlsdorf-Neuthard; Thomas Parr, Karlsruhe, both of Fed. Rep. of Germany

[73] Assignee: BMD Badische Maschinenfabrik Durlach GmbH, Karlsruhe, Fed. Rep. of Germany

[21] Appl. No.: 899,398

[22] Filed: Aug. 22, 1986

[30] Foreign Application Priority Data

Oct. 25, 1985 [DE] Fed. Rep. of Germany ..... 3537980

[51] Int. Cl.[4] ..... B28C 5/00

[52] U.S. Cl. ..... 366/2; 366/348

[58] Field of Search ..... 366/2, 6, 3–5, 366/64–66, 348, 154–156, 91, 76, 290, 167, 168, 172, 173

[56] References Cited

U.S. PATENT DOCUMENTS 4,304,493 12/1981 Frankie ..... 366/64 X

*Primary Examiner*—Timothy F. Simone

*Attorney, Agent, or Firm*—Antonelli, Terry & Wands

[57] ABSTRACT

In a process for mixing wet molding materials, particularly wet molding sands used for foundry purposes, the dry components of the molding materials are premixed in a container and, following the premixing of the moist components of the molding materials, are added and then homogenized with the dry components by further mixing. To reduce the mixing time, improve the mixing result and prevent contamination of mixer parts above free surface level of the dry components, the moist components are added under an overpressure to the premixed dry components below the surface level of the premixed dry components.

5 Claims, 1 Drawing Sheet

PROCESS FOR MIXING FOUNDRY MOLDING MATERIALS

BACKGROUND OF THE INVENTION

The present invention relates to a process for mixing wet molding materials, particularly wet molding sands, used for casting purposes the process includes premixing the dry components of the molding materials in a container followed by adding the moist components of the molding materials and then homogenizing the dry and moist components by further mixing.

Known mixing processes for foundry molding materials of the aforementioned type are performed in a variety of different mixer constructions. However, it is common to all these mixers for there to be a stationary or rotary, trough-like container, which is provided on its circumference or bottom with a discharge opening and into which mixing tools of different types may be engaged. The dry components are filled into the container from the top and the addition of moist components takes place above the surface level of the dry components. The dry components are formed from granular, free-flowing bulk materials, such as new sand and worked up used sand, as well as finely divided, almost dry bulk materials, such as coal dust and the like. The moist components are binders or bonding agents and are mainly in the form of sodium-bentonite, comprising layer or laminated particles, which are activated and swell when water is added. The swelling can be attributed to the incorporation of water molecules into the laminated mineral. Water-glass is also sometimes used as the binder which dries with the addition of air to produce the bond. The moist binder or binder components, are fed in above the surface level of the dry components.

In the known mixing processes, the wet molding material is produced batchwise, with particular importance being attached to short mixing times, so that the molding machine can constantly be supplied with wet molding material. The complete mixing cycle, which is essentially determined by the nature of the mixing tools and the circulation rate within the mixer, is at least two minutes in the known processes.

SUMMARY OF THE INVENTION

One objective of the present invention is to reduce the mixing time and obtain a better mixing result in the various mixer constructions.

According to the present invention, this objective is accomplished by adding the moist components under an overpressure below the surface level of the premixed dry components.

DETAILED DESCRIPTION OF THE DRAWING

Figure 1:
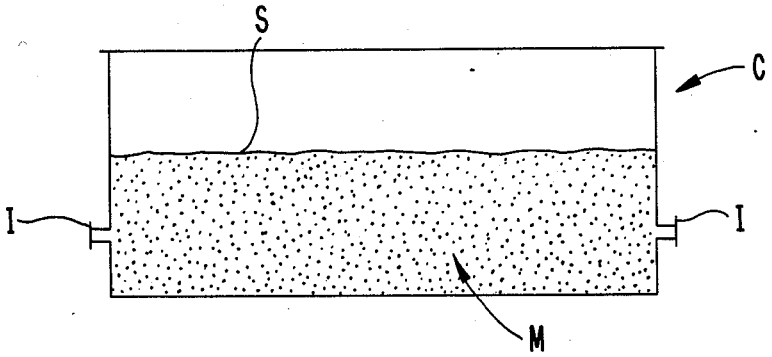
FIG. 1 is a cross-sectional vie showing an aspect of the present invention.

FIG. 1 is a cross-sectional view for describing the present invention. In particular, FIG. 1 shows a container, C, having injection points I, for adding moist components below the surfaace level, S, of premixed dry components to produce a mixture, M, of molding materials.

DESCRIPTION OF THE PREFERRED EMBODIMENTS

Unlike known mixing processes, in the process according to the present invention the moist components are introduced below the surface level of the premixed dry components. It has been found that the mixing time for the wet mixing cycle can be reduced to half a minute, whether bentonite or water-glass-bound molding materials are used. It has also been found that far fewer difficulties are encountered in obtaining an absolutely homogeneous mixture. This may be due to the following reasons.

When the moist components are added above the surface level of premixed dry components, agglomerates rapidly form which mainly comprise the moist components and the finely divided particles. Thus, the moist components are surrounded by a mostly dry jacket, which in extreme cases leads to the formation of lumps, which have a high moisture content in their interior. It is very difficult to intermix these lumps and it is also difficult to destroy them, which results in inhomogeneities in the mixed product and the necessary overdosing of the moist components. This is particularly critical in the case of bentonite-bound molding materials, because these lumps not only bind the binding water, but also the finely divided bentonite particles. These lumps lead to molding defects and upon casting to casting defects. As a result of the addition of the moist components below the surface level of the premixed dry components, bead and lump formation caused by the rolling of the moist components on the surface level is completely eliminated, because the moist components penetrating the premixed dry components under an overpressure develop a type of capillary system in which the moist components can be uniformly distributed from their charging point.

When using bentonite-bound molding materials, the process of the present invention not only leads to a reduction in the mixing time but, also to an improvement in the mixing result. Tests have shown that the swelling capacity of bentonite is time-dependent. Approximately 70% of the swelling capacity is achieved within 90 seconds from the start of the wetting of the bentonite particles, whereas a 100% swelling only takes place after 20 to 30 minutes. Thus, the reduction of the mixing time due to the process of the present invention, gives a corresponding increase of time to the swelling process, and leads to a better binding of the molding materials.

The process of the present invention also has another important advantage for the mixer operation and results. Upon adding the moist components above the surface level of the premixed dry components, there is necessarily a wetting of the mixer parts located above the surface. Thus, upon adding new dry components and during the dry mixing phase, sticking or caking occurs in the mixer areas wet during the preceding charge and such sticking and caking increases during long operating periods. This caked material gradually dries near the contact surface and breaks off every so often. The material is then transported below the mixing material and is not dissolved, so that inhomogeneities occur, which once again cause molding and casting defects. This phenomenon has critical significance when using water-glass-bound molding materials, because the caked material becomes as hard as glass and cannot be comminuted in the mixer. The process according to the present invention nearly eliminates this problem, so that the aforementioned inhomogeneities do not occur in the mixing material and cleaning measures required in the known mixing processes are either no longer necessary or can be carried out at much longer time intervals.

According to the present invention, the moist components are injected below the surface level of the premixed dry components, the overpressure being chosen so that the moist components do not or only just advance up to the surface level. It is also advantageous for the moist components to be added at several, preferably uniformly distributed points in the premixed dry components.

What is claimed is:

1. A process for mixing wet molding materials, used for foundry purposes, the process comprising premixing dry components of said molding materials in a container, adding moist components of said molding materials after said premixing, and then homogenizing said moist and dry components by further mixing, wherein said moist components are added under an overpressure to said premixed dry components below a surface level of said premixed dry components.

2. A process according to claim 1, wherein said moist components are injected into said premixed dry components.

3. A process according to claims 1 or 2, wherein said moist components are added to said premixed dry components at several points below said surface level of said premixed dry components.

4. A process according to claim 1, wherein said wet molding materials are wet molding sands.

5. A process according to claim 3, wherein said several points are uniformly distributed below said surface level of said premixed dry components.

* * * * *